US006811708B2

(12) United States Patent
Shaw et al.

(10) Patent No.: US 6,811,708 B2
(45) Date of Patent: Nov. 2, 2004

(54) CURB GUARD FILTER

(75) Inventors: Mark D. Shaw, Ponte Vedra Beach, FL (US); J. Tad Heyman, Atlantic Beach, FL (US); Laurence M. Bierce, Macclenny, FL (US)

(73) Assignee: UltraTech International, Inc., Jacksonville, FL (US)

( * ) Notice: Subject to any disclaimer, the term of this patent is extended or adjusted under 35 U.S.C. 154(b) by 46 days.

(21) Appl. No.: 10/390,462

(22) Filed: Mar. 17, 2003

(65) Prior Publication Data

US 2003/0173277 A1 Sep. 18, 2003

Related U.S. Application Data

(60) Provisional application No. 60/365,494, filed on Mar. 18, 2002.

(51) Int. Cl.[7] ..... E03F 5/06

(52) U.S. Cl. ..... 210/747; 210/162; 210/163; 210/480; 404/4

(58) Field of Search ..... 210/747, 767, 210/162, 163, 164, 170, 474, 479, 480, 481; 404/4, 5

(56) References Cited

U.S. PATENT DOCUMENTS

| | | | | | |
|---|---|---|---|---|---|
| 5,403,474 | A | | 4/1995 | Emery | |
| 5,405,539 | A | * | 4/1995 | Schneider | 210/747 |
| 5,632,888 | A | | 5/1997 | Chinn et al. | |
| 5,643,445 | A | * | 7/1997 | Billias et al. | 210/162 |
| 5,954,952 | A | | 9/1999 | Strawser, Sr. | |
| 6,214,216 | B1 | | 4/2001 | Isaacson | |
| 6,254,770 | B1 | * | 7/2001 | Remon | 210/163 |
| 6,274,036 | B1 | | 8/2001 | Ellis | |
| 2003/0047497 | A1 | * | 3/2003 | Harris et al. | 210/163 |

* cited by examiner

*Primary Examiner*—Christopher Upton
(74) *Attorney, Agent, or Firm*—Thomas C. Saitta

(57) ABSTRACT

An adjustable curb guard filter apparatus for filtering liquid flowing into a curbside drain and method for deploying the same. In accordance with one embodiment, the adjustable curb guard filter apparatus includes a filter sheet disposed between an upper and a lower of a pair of support bar members. The curb guard filter apparatus is deployed onto the curbside drain such that the ends of each of the support bar members exert an outwardly directed pressure against the inner lateral surfaces of the curbside drain enabling the filter sheet to form a substantially complete seal thereon. In a preferred embodiment, the lower end of the filter sheet is wrapped in a scroll-like manner around the lower support bar member such that when installed onto the curbside drain, the wrapped lower support bar member simultaneously provides dam and liquid filtration functionality along the bottom edge of the curbside drain.

18 Claims, 2 Drawing Sheets

CURB GUARD FILTER

CROSS REFERENCE TO RELATED APPLICATIONS

This application is a continuation of and claims priority from U.S. provisional patent application Ser. No. 60/365,494 filed on Mar. 18, 2002, the contents of which are incorporated herein by reference.

BACKGROUND OF THE INVENTION

1. Technical Field

The present invention relates generally to the field of filters or dams that are utilized to impede flow through curbside storm water drains, or the type often found adjacent to roads or parking lots. In particular, the present invention relates to an improved curb guard filter that may be advantageously applied to a vertical curbside inlet opening.

2. Description of the Related Art

Curbside drainage systems are designed to manage rain or other liquid runoff resulting from rainfall, liquid spills, etc., that flow onto streets, parking lots, and other proximate structures and areas. A curbside storm drain typically comprises a substantially vertical orifice in the side of a sidewalk curb and often has a grated opening disposed in the surface of the road or paved area in front of the curb drain. The runoff may be inherently toxic, or in the case of rainwater runoff, often picks up and carries various pollutants such as soil, rocks, oils, and other contaminants and is therefore potentially harmful to the downstream natural and artificial waterways that the storm drain system empties into.

In view of the potential for drain system contamination, it is often desirable, and sometimes mandated, that curb side drains be blocked or filtered in some manner to prevent or control the entry of contaminants into the drain system. For example, near construction sites or other area likely to be susceptible to toxic substance spillage, flow into the curb drain must be controlled so that undesirable matter, such as for example dirt, oil, debris, etc., does not enter the storm water drainage system.

Examples of devices which have been developed to preclude or to filter the liquid flow through a curb drain include those disclosed in U.S. Pat. No. 6,214,216 to Isaacson, U.S. Pat. No. 5,632,888 to Chinn et al., U.S. Pat. No. 5,403,474 to Emery, U.S. Pat. No. 6,274,036 to Ellis, and U.S. Pat. No. 5,954,952 to Strawser. For example, Isaacson discloses a catch basin insert or sock filter supported within a grated curb inlet storm drain. Adjustable, spring-loaded rods are inserted into loops on the edges of the catch basin filter and utilized to support the filter on the horizontal plane of the storm drain such that the horizontal support does not depend on the downward gravity force of the grate being applied on all four sides of the filter, or else the grate itself is used to secure the sock filter. A portion of the horizontally disposed filter is vertically extended in an L-shaped manner to provide a vertical filter or dam to prevent debris from passing through the curb inlet. In this configuration, the vertical dam is a single sheet supported on its upper end by an adjustable spring-loaded rod. There is however, no provision for securing the vertical dam at its lower end, and the device is clearly not useable where only a curb inlet with no storm drain is present. Thus, it will be relatively easy for the vertical dam to be moved or distorted out of position by the force of inflowing liquids and debris, and undesirable liquid or debris may readily pass around the vertical dam.

Chinn describes an environmental filter comprising an envelope of filter material that is proportioned to receive a storm drain inlet cover or other internal support device and provide filtration over drain catch basin. A vertical roll filter may be combined with the horizontally disposed envelope filter using straps, weights, pins, hooks, or anchors. Although effective in providing a robust barrier to inflowing particulates and debris, Chinn's utilization of a roll filter fails to provide comprehensive sealing of the vertical curb inlet orifice.

Emery discloses a portable curb inlet sediment filter having a box filter frame and a baffle panel defining a filter chamber and an overflow chamber. While providing a stable and comprehensive coverage of the vertical curb inlet orifice, Emery's box filter is unwieldy and, like Chinn's vertical roll filter, does not form a close seal along the mouth of the orifice.

The drain filter disclosed by Ellis is similar in overall structure and functionality to that shown by Isaacson, including a bag disposed over a horizontal drain portion and a debris dam provided at the upper edge of the back sidewall. Unlike Isaacson, the vertical debris dam depicted by Ellis is not a vertically deployed sheet member and instead comprises a porous cylindrical member that covers the face of a curb inlet slot. Like the roll filter and box filter shown by Chinn and Emery, Ellis's porous cylindrical member is not well-suited for forming a tight seal with the vertical curb drain inlet orifice.

Strawser discloses a stormwater catch basin filter assembly comprising a pair of metal frame elements bounding mesh filters, wherein one of the frames is sized to be co-extensive in area with the horizontal storm grate, and the others frame is sized to be co-extensive in area with the vertical curb inlet orifice. Utilizing rigid and non-adjustable frame elements, Strawser's filter assembly, similar to most of the foregoing described filter/dam devices, fails to provide an effective edge seal around a vertical curb inlet orifice.

Although effective for filtering particulates and some contaminants from entering a storm drain system, the foregoing systems are unnecessarily complex and difficult to implement, requiring the heavy cast metal drainage inlets or grates which is problematic for situations requiring quick selective filtration deployment. It can therefore be appreciated that there exists in the art a need for an improved and simplified curb guard filter device. The present invention addresses such a need.

SUMMARY OF THE INVENTION

An adjustable curb guard filter apparatus for filtering liquid flowing into a curbside drain and method for deploying the same are disclosed herein. In accordance with one embodiment, the adjustable curb guard filter apparatus includes a filter sheet disposed between an upper and a lower of a pair of support bar members. The curb guard filter apparatus is deployed onto the curbside drain such that the ends of each of the support bar members exert an outwardly directed pressure against the inner lateral surfaces of the curbside drain enabling the filter sheet to form a substantially complete seal thereon. In a preferred embodiment, the lower end of the filter sheet is wrapped in a scroll-like manner around the lower support bar member such that when installed onto the curbside drain, the wrapped lower support bar member simultaneously provides dam and liquid filtration functionality along the bottom edge of the curbside drain.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
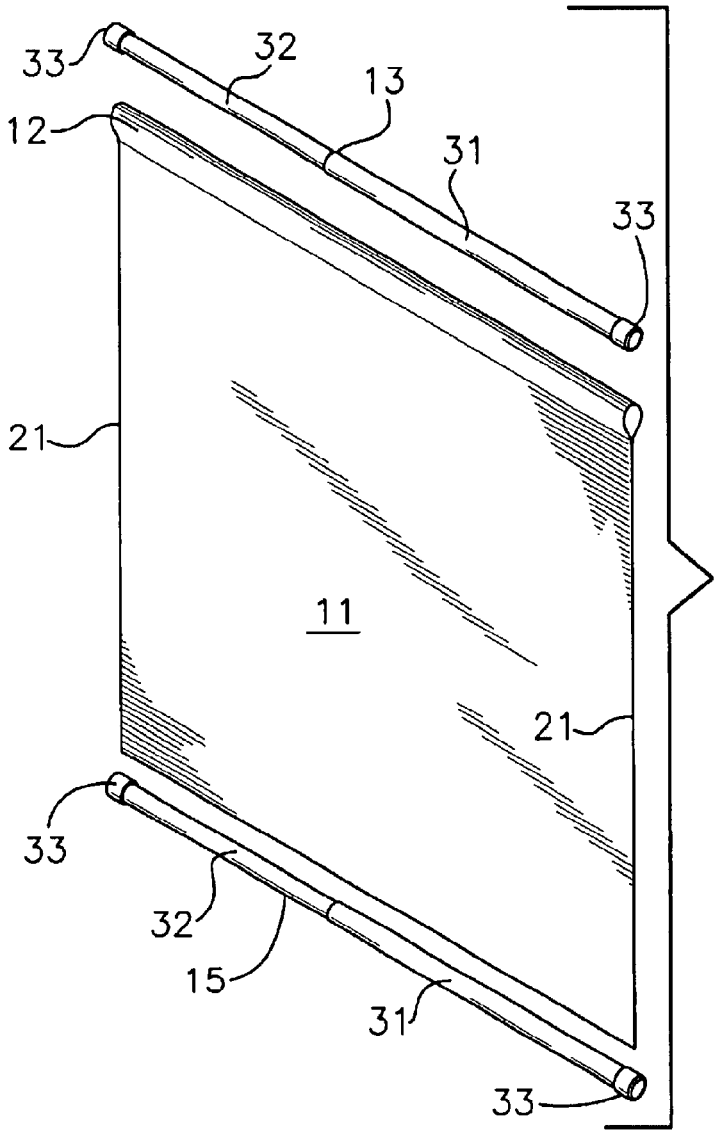
FIG. 1 is an expanded view of the invention showing the support members separated from the sheet material.

The present invention is described in a preferred embodiment in the following description with reference to the figures. While this invention is described in terms of the best mode for achieving this invention's objectives, it will be appreciated by those skilled in the art that variations may be accomplished in view of these teachings without deviating from the spirit or scope of the invention.

As explained in further detail with reference to the figures, the present invention is directed generally to a curb drain guard device which functions to control the passage of liquid into and through a drain opening disposed on the side of a curb, and most preferably is a device advantageously combining filtration and damming/blocking functionality with respect to liquids and debris passing into the curbside drain. As utilized herein, a "curbside drain" is a gap or opening formed in the side of a curb that allows liquid run-off to flow into a storm water removal system. The curb drain guard of the present invention is laterally and vertically adjustable to provide selective filtration and dam blockage of curb drains having differing dimensions, the drain guard including means for securely supporting the device within a curbside drain opening such that a flexible dam or filter material is extended across the opening.

In a preferred embodiment, the curbside drain guard serves a dual role as either or both a filter and a dam depending on the material properties and relative disposition of a pair of adjustable length, rod-like, horizontally disposed support bar members and a sheet-like, flexible, generally rectangular, member disposed between the support bar members. Preferably, the sheet member comprises a filtering material enabling the passage of acceptable liquids such as water while preventing passage of undesirable liquid, particulate or solid matter into the curbside drain. Alternatively, all or selected zones of the sheet member comprise an impermeable material that prevents ingress of liquids into the curbside drain. Each of the top and bottom ends of the filter sheet is preferably attached to a support bar member, such as by providing pockets or loops.

The support bar members are extendable or retractable in preferably a telescoping manner so that the length of the support bar members can be adjusted as needed. Preferably, the width or horizontal dimensions of the filtering sheet material is greater than the maximum extended length of the support members, such that a portion of the sides of the material can be positioned between the ends of the support members and the sides of the curb drain. Most preferably, the height or vertical dimension of the material is greater than the height of the curb drain, such that a portion of the material can be rolled around the lower support member in a scroll-like fashion, thereby increasing the filtering function of the device on its lowermost portion as well as forming a compressible seal for the bottom of the device.

With reference now to the figures, wherein like reference numerals refer to like and corresponding parts throughout, and in particular with reference to FIGS. 1–4, the invention is an adjustable curb guard filter comprising a pair of support bar members including an upper support bar member 13 and a lower support bar member 15. In accordance with the depicted embodiment, a sheet member 11 is disposed between upper support bar member 13 and lower support bar member 15, which together retain sheet member 11 in a specified manner within a curbside drain 98. Sheet member 11 is a flexible material that can be folded and rolled about support bar members 13 and/or 15 in scroll-like manner. Sheet member 11 may be composed of a polymeric or fabric composition which may be impermeable to liquid, but which most preferably performs a filtering function whereby only selected liquid may pass through sheet member 11. Sheet member 11 may for example be a monofilament, a needle punch polypropylene, a Xertex brand polymer, or any other similar material that allows passage of desired liquid, such as water, while preventing passage of physical components and undesired liquids, such as sediment, heavy metals, trash or oil for example.

The curb guard filter apparatus is installed onto curbside drain 98 such that the ends of each of upper and lower support bar members 13 and 15 exert an outwardly directed pressure against the inner lateral surfaces of curbside drain 98 enabling sheet member 11 to form a substantially complete seal thereon. To this end, the support bar members 13 and 15 are preferably adjustable lengthwise in the horizontal use direction such that they may be extended or retracted in length as required to fit the lateral dimensions of a curbside drain 98. Such elements are commonly referred to as tension rods. As explained below, the nature of the seal formed over curbside drain 98 in terms of relative permeability and corresponding usage as a filter or dam depends on the material properties of sheet member 11.

Figure 2:
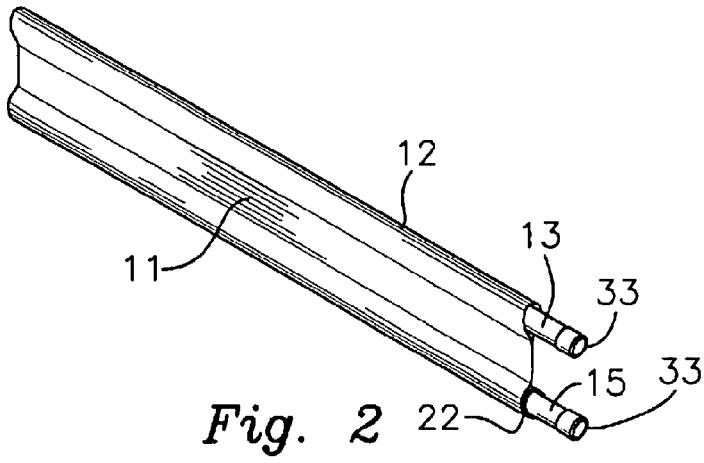
FIG. 2 is a perspective view showing the support members inserted into the material pockets ready for insertion into a curb drain.

In the embodiments shown in FIGS. 1–4, support bar members 13 and 15 are telescoping tubes having an outer sleeve 31 annularly disposed about an inner sleeve 32, which may be spring-biased so as to maintain support bar members 13 and 15 in the maximum extended position. Alternatively, other biasing means, such as for example use of threaded inner and outer sleeves 32 and 31, may be substituted for the spring biasing means. As depicted in FIGS. 1 and 2, end cap members 33, preferably made of rubberized or other high friction gripping material, may be disposed on the ends of support bar members 13 and 15 to provide a more secure mount within curbside drain 98.

Sheet member 11 preferably has a substantially rectangular edge contour and is adapted to be secured by support bar members 13 and 15 within curbside drain 98 in a manner that ensures a comprehensive seal on the curbside drain orifice. One or more of the opposing non-lateral upper and lower edges of sheet member 11 are provided with connection means 12, which as illustrated comprises a laterally extending pocket member 12 sized to receive upper support bar member 13. Alternatively, loops or mechanical fastening means may be utilized to connect the upper and lower ends of sheet member 11 to upper and lower support members 13 and 15. In still another alternative, sheet member 11 may be attached by other means, such as by adhesive bonding, to support bar members 13 and/or 15. Preferably, both the upper and lower ends of sheet member 11 are securely connected to support bar members 13 and 15, respectively, although it is possible to provide an adequately secure coupling of the lower end of sheet member 11 to lower support bar member 15 by rolling or wrapping a segment of the lower end of sheet member 11 around lower support bar member 15. Where sheet member 11 is not permanently connected to support bar members 13 and 15, replacement of sheet member 11 is easily accomplished.

The curb drain guard apparatus of the present invention further includes an enhanced lateral edge sealing feature enabled by selecting the width of sheet member 11 to be greater than the maximum lateral dimension of support bar members 13 and 15. Excess lateral material of sheet member 11 may be trimmed by the user, but it is preferred that the lateral width dimension of sheet member 11 remain such that side edges 21 can be folded or otherwise positioned between end caps 33 of support bar members 13 and 15 and the inner lateral surfaces of curbside drain 98 in order to better seal the lateral edges of curbside drain 98.

Figure 3:
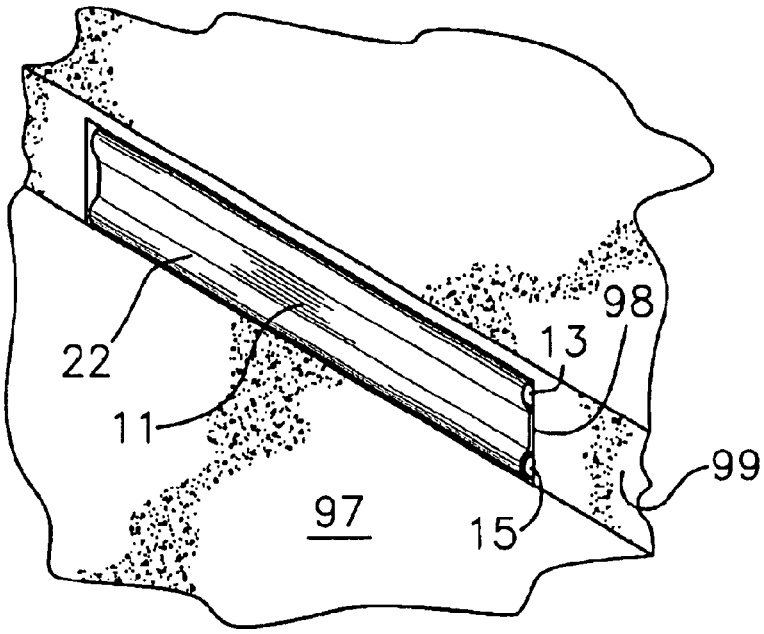
FIG. 3 is a perspective view showing the invention as inserted into a curb drain.
Figure 4:
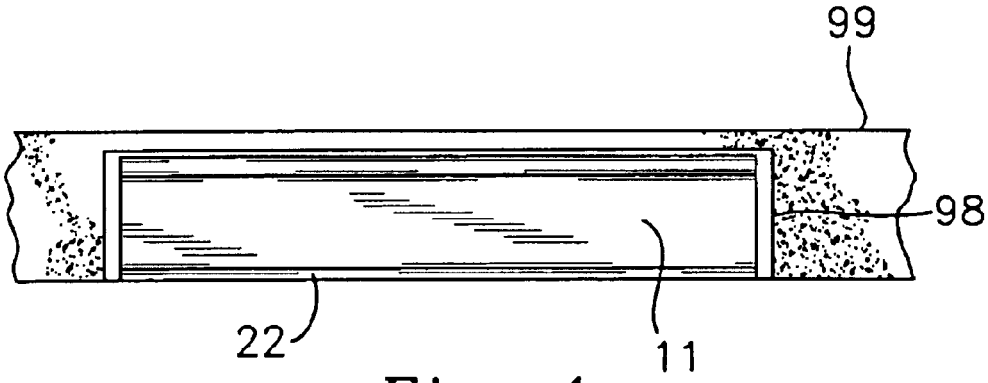
FIG. 4 is a front view showing the invention as inserted into a curb drain.

As illustrated in FIGS. 3 and 4, the adjustable curb guard apparatus is mounted onto curbside drain 98 on a curb 99 such that upper support bar member 13 is positioned internally across the top of curbside drain 98 and lower support bar member 15 is positioned internally across the bottom of curbside drain 98. In accordance with a preferred embodiment, an excess length of material on the lower end of sheet member 11 is wrapped or rolled about lower support bar member 15 in a scroll-like manner to create a multi-layer filter portion 22, such that a higher degree of filtration is provided when the liquid level is relatively low. Should the liquid level rise, the single layer upper portion of sheet member 11 allows for a greater flow rate. In addition, the multi-layer filter portion 22 in which lower support bar member 15 is annularly encased within multiple turns of the sheet member material advantageously combines rigid lateral support provided by lower support bar member 15 with compressible multi-layer liquid filtration to provide a compressibly sealed dam/filter member wherein lower support bar member 15 may be pressed downward against the bottom of the curbside drain 98 or the pavement 97 to better prevent liquid from passing unfiltered beneath the device while providing a rigid dam barrier that imparts impact resistance against larger debris or strong liquid currents encountered by the vertically disposed curd drain guard apparatus.

To effectuate the wrapped multiplayer filtration dam 22 the vertical dimension of sheet member 11 is preferably significantly greater than the vertical dimension of a curb drain 98. For example, a typical curb drain 98 has a lateral dimension of about twenty-eight inches and a vertical dimension of about six inches. As shown, the vertical dimension of sheet member 11 may be as great as the lateral dimension, forming for example a square greater than 28×28 inches.

While this invention has been described in terms of several embodiments, it is contemplated that alterations, permutations, and equivalents thereof will become apparent to one of ordinary skill in the art upon reading this specification in view of the drawings supplied herewith. It is therefore intended that the invention and any claims related thereto include all such alterations, permutations, and equivalents that are encompassed by the spirit and scope of this invention.

What is claimed is:

1. An adjustable curb guard filter apparatus for filtering liquid flowing into a curbside drain, said adjustable curb guard filter apparatus comprising a filter sheet disposed between an upper and a lower of a pair of support bar members, wherein the ends of each of the upper and lower support bar members exert an outwardly directed pressure against the inner lateral surfaces of the curbside drain such that the filter sheet forms a substantially complete seal thereon.

2. The adjustable curb guard filter apparatus of claim 1, wherein the lower edge of said filter sheet includes a pocket through which said lower support bar is inserted.

3. The adjustable curb guard filter apparatus of claim 1, wherein the upper end of said filter sheet includes a pocket through which the upper support bar member is inserted.

4. The adjustable curb guard filter apparatus of claim 1, wherein the length of one or both of said pair of support bar members is adjustable.

5. The adjustable curb guard filter apparatus of claim 1, wherein one or both of said pair of support bar members comprise spring-biased tension rods.

6. The adjustable curb guard filter apparatus of claim 1, wherein one or both of said pair of support bar members comprise length adjustable threaded tubes.

7. The adjustable curb guard filter apparatus of claim 1, wherein the opposing ends of each of the upper and lower support bar members are capped with a rubberized gripping material.

8. The adjustable curb guard filter apparatus of claim 1, wherein said filter sheet is substantially rectangular and having a width greater than the length of said upper and lower support bar members such that a portion of the lateral sides of the filter sheet can be positioned between the ends of the upper and lower support bar members and the inner lateral surfaces of the curbside drain.

9. The adjustable curb guard filter apparatus of claim 1, wherein said filter sheet is a flexible sheet constructed of a liquid permeable polymeric or fabric material that selectively passes water while preventing passage of debris components into the curbside drain.

10. The adjustable curb guard filter apparatus of claim 1, wherein said filter sheet is constructed of a monofilament material.

11. The adjustable curb guard filter apparatus of claim 1, wherein said filter sheet is constructed of a needle punch polypropylene material.

12. The adjustable curb guard filter apparatus of claim 1, wherein said filter sheet is constructed of a polymer material.

13. The adjustable curb guard filter apparatus of claim 1, wherein an upper end of said filter sheet is fixedly attached to the upper support bar member, and wherein a lower end of said filter sheet is wrapped around the lower support bar member such that when installed onto the curbside drain, the wrapped lower support bar member simultaneously provides dam and liquid filtration functionality along the bottom edge of the curbside drain.

14. The adjustable curb guard filter apparatus of claim 13, wherein the lower end of said filter sheet is rolled multiple times around the lower support bar member to form a compressible, multi-layer liquid filter and dam along the bottom edge of the curbside drain.

15. The adjustable curb guard filter apparatus of claim 13, wherein the lower end of said filter sheet is wrapped around said lower support bar member in a scroll-line manner.

16. A method for filtering liquid flowing into a curbside drain, said method comprising deploying an adjustable curb guard filter apparatus onto said curbside drain wherein the adjustable curb guard filter apparatus includes a filter sheet disposed between an upper and a lower of a pair of support bar members, wherein the ends of each of the upper and lower support bar members exert an outwardly directed pressure against the inner lateral surfaces of the curbside drain such that the filter sheet forms a substantially complete seal thereon.

17. The method of claim 16, wherein an upper end of said filter sheet is fixedly attached to the upper support bar member, said method further comprising:

wrapping a lower end of said filter sheet around the lower support bar member; and installing the wrapped lower support bar member along the bottom edge of the curbside drain such that the wrapped lower support bar member simultaneously provides dam and liquid filtration functionality along the bottom edge of the curbside drain.

18. The method of claim 17, wherein said wrapping step comprises rolling the lower end of said filter sheet multiple times in a scroll-like manner around the lower support bar member to form a compressible, multi-layer liquid filter and dam along the bottom edge of the curbside drain.

* * * * *